United States Patent [19]

Robbins

[11] Patent Number: 4,625,195

[45] Date of Patent: Nov. 25, 1986

[54] ELECTRIC FUSE HAVING POSITIONING MEANS FOR ARC-QUENCHING CORE

[75] Inventor: Richard W. Robbins, Exeter, N.H.

[73] Assignee: Gould Inc., Rolling Meadows, Ill.

[21] Appl. No.: 677,125

[22] Filed: Dec. 3, 1984

[51] Int. Cl.[4] ..... H01H 85/04; H01H 85/44

[52] U.S. Cl. ..... 337/159; 337/279

[58] Field of Search ..... 337/159, 160, 281, 273, 337/279

[56] References Cited

U.S. PATENT DOCUMENTS 3,935,553 1/1976 Kozacka et al. ..... 337/160

4,216,457 8/1980 Panaro ..... 337/159

*Primary Examiner*—Harold Broome

*Attorney, Agent, or Firm*—Frederick A. Goettel, Jr.

[57] ABSTRACT

An electric cartridge fuse having a channel shaped fusible link section which carries a gas evolving core is provided with means for assuring positive axial positioning of the core without requiring deformation of the fuse link. The gas evolving core is provided with a lateral protrusion which extends through and operatively engages one of the perforations in the fuse link thereby positively axially positioning the core with respect to the fuse link.

4 Claims, 4 Drawing Figures

ELECTRIC FUSE HAVING POSITIONING MEANS FOR ARC-QUENCHING CORE

BACKGROUND OF THE INVENTION

1. Field of the Invention

The present invention relates to electric cartridge fuses having a core means associated therewith for assisting in quenching of the arc formed upon interruption of the fuse. More specifically, it is directed to a means for assuring the position of such an arc-quenching core with respect to the fusible element of such an electric fuse.

2. Description of the Prior Art

U.S. Pat. No. 3,935,553, entitled "Cartridge Fuse for DC Circuits," issued on Jan. 27, 1976, is assigned to the same assignee as the present invention. The disclosure of the above-identified U.S. Pat. No. 3,935,553 is hereby incorporated by reference in its entirety.

As set forth in U.S. Pat. No. 3,935,553, it has been found particularly advantageous in a number of electrical cartridge fuse designs to incorporate a core, made from a gas evolving electric insulating material, in close operative engagement with certain portions of the fusible elements of such electric fuses. Proper positioning of such gas evolving cores permits arc-quenching gasses to be released by the core upon melting of the fusible element at a particularly advantageous location wherein it will assist in extinguishing the arc while not contributing to generating, under certain operating conditions, undesirable excessive pressures within the fuse. Experience with fuses of the type disclosed in the '553 patent has shown that the axial positioning of the gas evolving core or cores with respect to the fusible element with which it is associated is extremely critical.

One technique which has evolved for assuring axial positioning of the gas evolving cores in such fuses has been to deform portions of the fusible element surrounding the core in order to retain the axial position of the cores. Such a solution has proved to be an undesirable approach to the problem and it is towards means for readily assuring precise axial positioning of the cores in such a fuse that the present invention is directed.

SUMMARY OF THE INVENTION

Electric cartridge fuses according to the present invention include a tubular outer casing made from electric insulating material and having a pair of electrically conductive terminal elements closing the ends of the casing. A ribbon fuse link conductively interconnects the pair of end terminals. The fuse link includes a plurality of transverse lines of perforations and a plurality of longitudinal columns of perforations in the center section thereof. The center section is bent into a substantially closed longitudinally extending channel defining one or more inwardly facing surfaces and an outwardly facing peripheral surface. Means for evolving arc-quenching gasses under the heat of an electric arc are positioned and restrained within the longitudinally extending channel at a predetermined lateral position by engagement with the inwardly facing surfaces of the channel. The means for evolving gasses also includes means for operatively engaging, and axially fixing itself with respect to, the longitudinally extending channel defined by the fuse link. An arc-quenching filler material is provided inside the casing surrounding the fuse link at all points of the link which are out of engagement with the gas evolving means.

In accordance with a specific embodiment of the invention, the gas evolving means comprises a lateral protrusion integrally formed with the gas evolving means which extends through and operatively engages one of the perforations in the fuse link thereby serving to positively axially restrain the gas evolving core. Extension of the lateral protrusion through the perforation by a predetermined distance may further serve to space the fusible element or core from an adjacent element-/core assembly or other adjacent structure.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of the preferred embodiment when read in connection with the accompanying drawings wherein like numbers have been employed in the different figures to denote the same parts and wherein:

DESCRIPTION OF THE PREFERRED EMBODIMENTS

Figure 1:
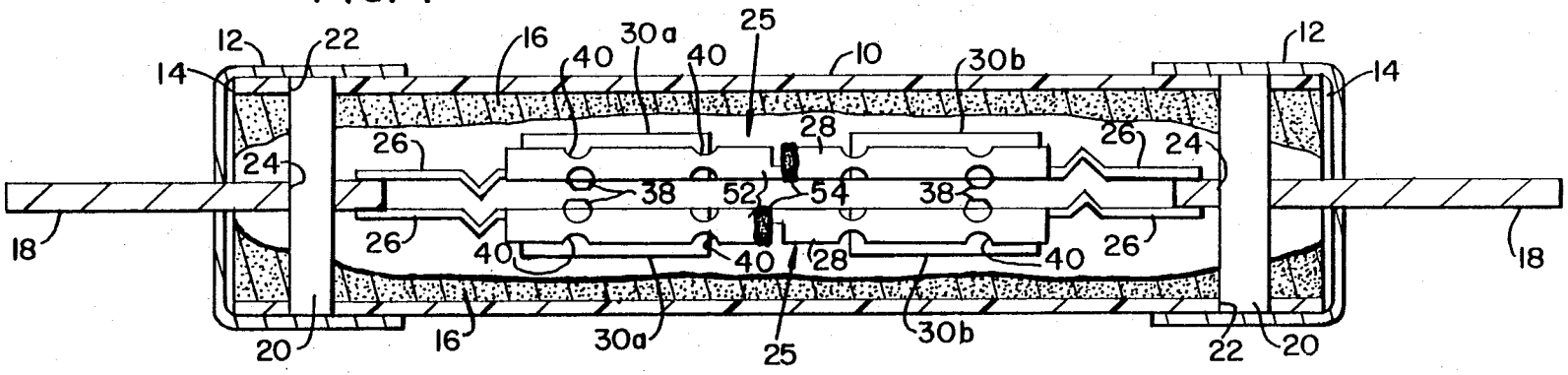
FIG. 1 is a longitudinal sectional view of an electric fuse embodying the present invention.

Referring now to FIG. 1, reference numeral 10 has been applied to indicate a tubular casing of electric insulating material which is closed by a pair of electroconductive terminal caps 12 and washers 14 which are interposed between the axially outer ends of the casing 10 and the caps 12. A pulverulent arc-quenching filler 16 has only been indicated adjacent the interface with the casing 10, but actually fills the entire volume of casing 10, except where other parts within the casing are located. A pair of blade contacts 18 project from the outside of casing 10 through the end caps 12 and washers 14 into the interior of the fuse, and are fixedly positioned by a pair of pins 20. The pins 20 project through bores 22 in casing 10 and bores 24 in blade contacts 18. The blades 18 are electrically conductively interconnected at their ends in the interior of the tube 10 by a pair of fusible elements 25, made from a sheet material, having axially outer ends or connecting tabs 26. The connecting tabs 26, which are narrower than the perforated center 28 of the fusible element which will be described below, are electrically conductively attached, preferably by welds, to opposite sides of the blades 18.

Such an arrangement results in each fusible element 25, which comprises a pair of end tabs 26 and its associated perforated center portion 28, defining a current path in the fuse extending between the inner ends of the blades 18. Each current path lies in a plane spaced from and parallel to a plane defined by the blades 18.

Figure 2:
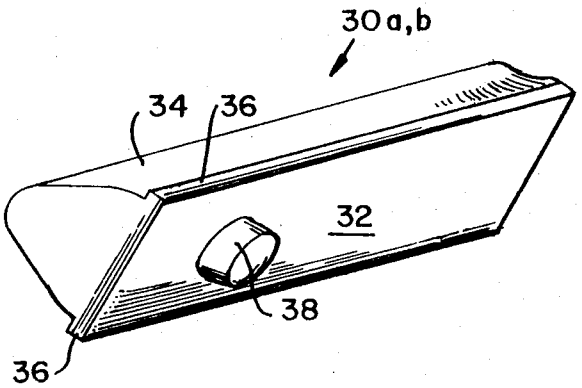
FIG. 2 is an isometric view of a gas evolving core embodying this invention.

Each of the centrally positioned perforated fusible element portions 28 has associated therewith a pair of rod-shaped 30A, 30B segments made from a gas evolving electric insulating material. One of such gas evolving means is shown in an enlarged perspective view in FIG. 2 and is seen to have a cross section which is substantially in the shape of a parabola and which is defined more specifically by a substantially planar surface 32 and a curved surface 34. Longitudinally extending ridges 36, are provided at the edges of the planar surface to facilitate in molding the gas evolving rod means. Extending from the planar surface 32 of each of the gas evolving means is a lateral protrusion 38 integrally formed with the gas evolving means and having a circular cross-section sized to operatively engage one of the perforations in the fuse link section with which it is associated as will now be described in more detail.

Figures 3, 4:
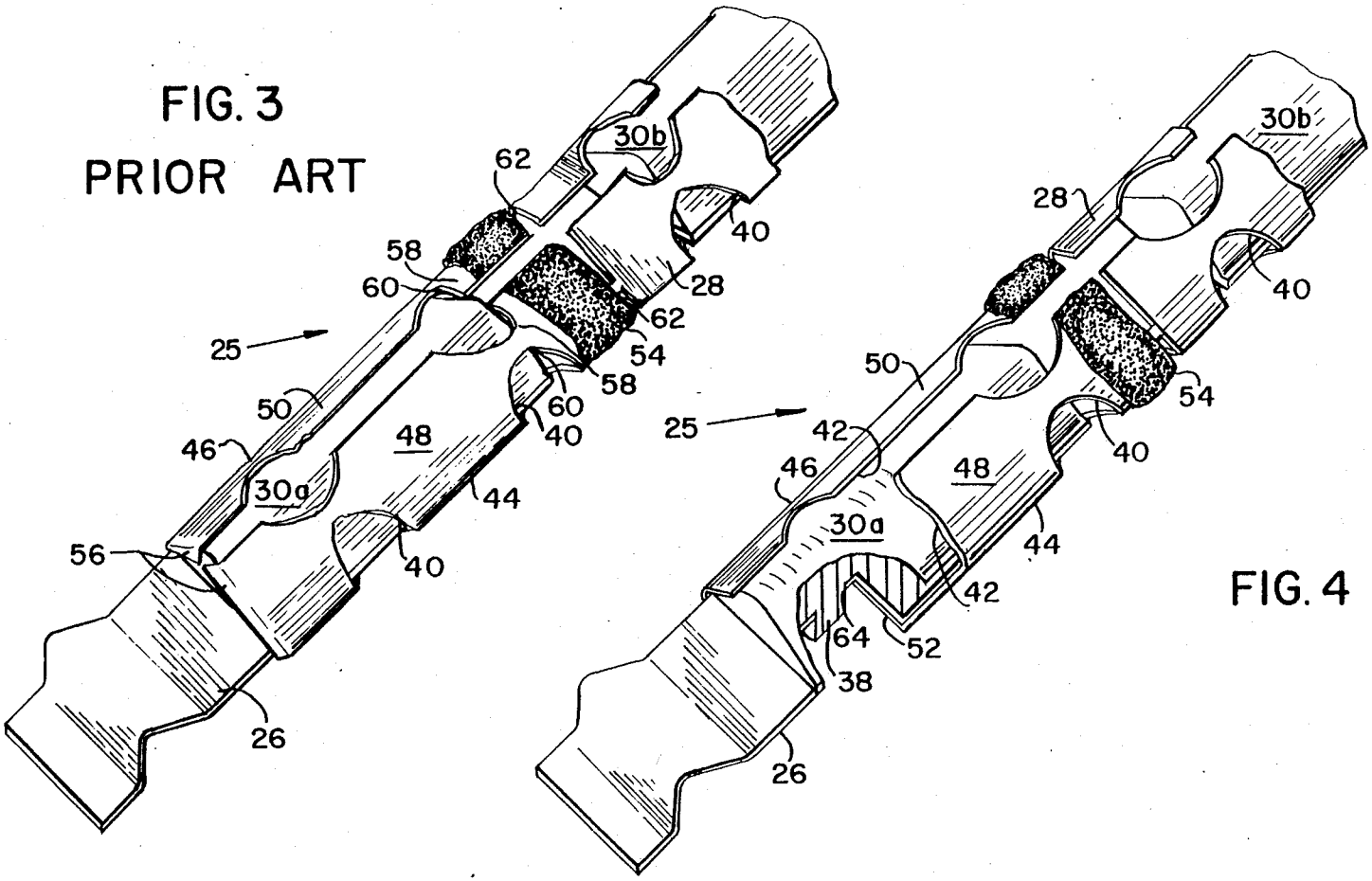
FIG. 3 PRIOR ART
FIG. 3 is an isometric view of a fuse according to the Prior Art.
FIG. 4 is an isometric view partially broken away of a fuse embodying the present invention.

Each of the portions 28 of the fusible elements 25 extending between the end tabs 26, and with which the gas evolving means are associated, are provided with a plurality of transverse lines of perforations and a plurality of longitudinal columns of perforations as seen in FIGS. 1, 3, and 4 and generally identified by reference numeral 40. The perforated wide portion 28 of the fuse link is wrapped around each of the gas evolving rod means 30A, 30B so as to define one or more inwardly facing surfaces 42 which engage and laterally position the gas evolving rods 30A, 30B with respect to the fusible element. More specifically the perforated fusible element portion 28 of the fuse link is bent along two straight lines 44 and 46 and includes two lateral portions 48 and 50 wrapped around the curved surface 34 of the gas evolving means 30A and 30B. Such configuration defines a planar base 52 for each of the fusible element portions 28 which is in confronting relation to the planar surface 32 of the gas evolving rod means 30A and 30B.

Reference character 54 has been applied to indicate an overlay of a low fusing point fuse link-severing metal, e.g. tin, supported by the base metal of which the ribbon fuse link is made, e.g. copper or silver. The link severing overlay 54 extends transversely across the central portion 28 of the ribbon fuse link from one edge to the other and is in directly adjacent relationship to the centrally located transverse line of perforations 40.

In the embodiment shown, the centrally located group of transverse lines of perforations, comprises a plurality of rectangularly shaped perforations, which in combination with the link severing metal overlay 54 described above serve to very effectively interrupt small protracted overload currents in the circuit which the fuse is intended to protect.

Under such conditions of relatively small protracted overload currents interruption of the fuse is initiated by fusion of the overlay 54. Fusion of the overlay 54 occurs at a temperature which the gas evolving means 30A, 30B can withstand for long periods of time, even if made of a synthetic resin, for example a melamine resin. Following fusion of the overlay 54 the resistance of the area of the fusible element coextensive with the overlay increases greatly due to the formation of alloys of high resistivity, resulting in a rise of temperature at this area far above the fusing point of the overlay. This phenomenon is known as the "Metcalf effect". This post-fusion and pre-arcing rise in temperature has the tendency to damage parts made from synthetic resins which are arranged immediately adjacent the overlay 54. For this reason two separate gas evolving cores 30A, 30B are positioned within the channel defined by the ribbon fuse link, with each of the gas evolving cores spaced a predetermined distance from the overlay 54. Accordingly, in response to a protracted overload current arcing and burnback are initiated after the ribbon fuse link 25 is severed at its center into two separate parts, with the burnback pattern progressing towards the gas evolving rods 30A, 30B whereupon large amounts of arc-quenching gasses are evolved by the rods.

It is also well known that, during major fault currents or short circuits, it is undesirable to have large quantities of gas evolving materials in the arcing zone of a fuse because excessive pressures may be generated within the fuse tube.

Accordingly, positioning of the two gas evolving means 30A, 30B with respect to the channel formed by the central perforated section 28 of the fusible elements, specifically, axial positioning of the gas evolving means with respect to the low melting point overlay 54, is extremely important to the operation of the fuse.

Frictional engagement between the inwardly facing surfaces 42 of the channels has proved unsatisfactory to axially position the gas evolving means within the channels. One technique which has evolved for assuring retention and axial positioning of the gas evolving means 30A, 30B within the channel defined by the fusible element has been to deform the axially outer ends of the channel portions of the fusible element as shown in FIG. 3 at reference numeral 56. Such deformation of the outer ends serves to prevent the gas evolving means from sliding out of the channel defined by the perforated portion of the fusible element. Further, as shown in FIG. 3, retention and positioning of the axially inner ends of the gas evolving means has been accomplished by deformation of the portion of the perforated channel adjacent the end of the gas evolving means as shown at reference numeral 58. While such deformation has served to axially restrain and position the gas evolving means the deformation of the channel portion of the fusible element, particularly the ends adjacent the inner ends of the gas evolving means which are spaced from the link severing metal overlay 54, has resulted in undesirable deformation of the fusible element in this region as is illustrated in FIG. 3.

Specifically, such deformation has resulted in distortion and weakening of the areas of reduced cross-section 60 which are immediately adjacent the portion of the perforated channel bent around the axially inner ends of the gas evolving means. Further, such bending of the channel portion has resulted in distortion of the centrally located group of rectangularly shaped perforations which have the link severing metal overlay 54 adjacent thereto as shown at reference numeral 62.

A comparison of the fusible element assemly shown in FIG. 4 wherein the gas evolving means 30A, 30B are positioned according to the present invention, with the prior art fuse link assembly of FIG. 3 emphasizes the drasticly improved benefits of the positioning means of the present invention. As is evident from FIG. 4 the channel shaped perforated portion of the fusible element continues to serve to laterally restrain gas evolving means 30A, 30B however the engagement of the integrally formed protrusion 38 with a mating aperture 64 in the planar portion 52 of the channel serves to positively axially restrain the gas evolving means within the channel with absolutely no distortion of the fragile perforated channel portion of the element required.

Referring specifically now to FIG. 1, a pair of fuse link/gas evolving core arrangements, again as described hereinabove, are arranged in parallel spaced relationship with respect to one another in an electric cartridge fuse. It will be seen that the integrally formed protrusions 38 of the gas evolving means 30A, 30B in the two sets of fusible elements are arranged so that they are in spaced confronting relationship with one another. In such a design the distance which the protrusions 38 extend beyond the outer planar surface 52 of the channel in which they are restrained is selected such that the protrusions 38 of adjacent gas evolving means will serve to space the parallel extending fusible elements from one another a distance equal to the combined length which the two protrusions extend beyond their respective perforated channel sections. Such an arrangement assures that the elements are separated at least by this minimum distance during assembly of the fuse and during the life time of the fuse. Such spacing is extremely important in that it assures that an adequate amount of the pulverulent arc-quenching filler 16 may enter into the region between the adjacent elements thereby assuring reliable predictable operation of the fuse.

Accordingly it should be appreciated that there has been provided a simple yet extremely effective means for assuring proper positioning of a gas evolving core with respect to a channel shaped fusible element. The cores are supported within the channel without requiring any deformation of the fusible element in the perforated regions thereof which are extremely fragile and sensitive to unnecessary deformation thereof. The axial positioning means further cooperates with the axial positioning means of an adjacent fuse element to assure proper spacing of the elements from one another in a fuse in which they are employed.

This invention may be practiced or embodied in still other ways without departing from the spirit or essential character thereof. The perferred embodiments described herein are therefore illustrative and not restrictive, the scope of the invention being indicated by the appended claims and all variations which come within the meaning of the claims are intended to be embraced therein.

What is claimed is:

1. An electric cartridge fuse comprising:

A. a tubular casing of electric insulating material;

B. a pair of electroconductive terminal elements closing the ends of said casing;

C. a ribbon fuse link conductively interconnecting said pair of terminal elements, said fuse link including a center section having a plurality of transverse lines of perforations and a plurality of longitudinal columns of perforations, said center section being bent into a substantially closed longitudinally extending channel defining one or more inwardly facing surfaces, and an outwardly facing peripheral surface;

D. means for evolving arc-quenching gasses under the heat of an electric arc, said gas evolving means being restrained within said longitudinally extending channel at a predetermined lateral position by engagement with said one or more inwardly facing surfaces of said channel;

E. means, comprising a protrusion from a lateral surface of said means for evolving gasses, for operatively engaging said longitudinally extending channel and axially fixing said means for evolving gasses with respect to said longitudinally extending channel; and F. a pulverulent arc-quenching filler inside said casing surrounding said fuse link at all points thereof out of engagement with said gas evolving means.

2. An electric fuse according to claim 1 wherein said means for operatively engaging and axially fixing said gas evolving means comprises a lateral protrusion integrally formed with said gas evolving means, said protrusion being sized to extend through and operatively engage one of said perforations in said fuse link thereby serving to prevent axial movement thereof.

3. An electric fuse according to claim 2 wherein said lateral protrusion which extends through said one of said perforations extends beyond the outwardly facing peripheral surface by a predetermined distance.

4. An electric cartridge fuse comprising:

A. a tubular casing of electric insulating material;

B. a pair of electroconductive terminal elements closing the ends of said casing;

C. a first ribbon fuse link conductively interconnecting said pair of terminal elements, and a second ribbon fuse link extending parallel to said first ribbon fuse link and also conductively interconnecting said pair of terminal elements, said first and second fuse links each including a center section having a plurality of transverse lines of perforations and a plurality of longitudinal columns of perforations, each of said center sections being bent into a substantially closed longitudinally extending channel defining one or more inwardly facing surfaces, and an outwardly facing peripheral surface;

D. means for evolving arc-quenching gasses under the heat of an electric arc, at least one of said gas evolving means being restrained within each of said longitudinally extending channels of said first and second fuse links at a predetermined lateral position by engagement with said one or more inwardly facing surfaces of said channels;

E. means carried by each of said means for evolving gasses for operatively engaging and axially fixing of said means for evolving gasses with respect to their respective longitudinally extending channel, each of said means for axially fixing comprising a lateral protrusion integrally formed with said gas evolving means, said protrusions being sized to extend through and to operatively engage one of said perforations in each of said first and second fuse links thereby serving to prevent axial movement of said gas evolving means with respect to said first and second fuse link;

F. said first and second ribbon fuse links being further positioned such that the lateral protrusions associated with their respective means for axially fixing are in facing relationship with one another and wherein each of said lateral protrusions extends through its respective perforation beyond the outwardly facing peripheral surface of its respective channel by a predetermined distance, whereby said lateral protrusion of said first ribbon fuse link and said lateral protrusion of said second ribbon fuse link may engage one another in cooperative relationship to keep said first and second ribbon fuse links a predetermined distance from one another; and G. a pulverulent arc-quenching filler inside said casing surrounding said first and second fuse links at all points thereof out of engagement with said gas evolving means.

* * * * *